US010573960B1

(12) United States Patent
Radey

(10) Patent No.: US 10,573,960 B1
(45) Date of Patent: Feb. 25, 2020

(54) POWER ANTENNA ADAPTER

(71) Applicant: Charles Radey, Manitowoc, WI (US)

(72) Inventor: Charles Radey, Manitowoc, WI (US)

( * ) Notice: Subject to any disclaimer, the term of this patent is extended or adjusted under 35 U.S.C. 154(b) by 2 days.

(21) Appl. No.: 16/153,812

(22) Filed: Oct. 7, 2018

(51) Int. Cl.

| | |
|---|---|
| ***H01Q 1/24*** | (2006.01) |
| ***H01Q 1/32*** | (2006.01) |
| ***H01Q 1/12*** | (2006.01) |
| ***H01Q 9/04*** | (2006.01) |

(52) U.S. Cl.
CPC ..... *H01Q 1/325* (2013.01); *H01Q 1/1207* (2013.01); *H01Q 1/24* (2013.01); *H01Q 9/04* (2013.01)

(58) Field of Classification Search
CPC .. H01Q 1/32; H01Q 1/12; H01Q 1/24; H01Q 9/04
USPC ..... 343/711
See application file for complete search history.

(56) References Cited

U.S. PATENT DOCUMENTS

2007/0046551 A1* 3/2007 Tateno ..... H01Q 1/1214 343/713
2014/0159968 A1* 6/2014 Maier ..... B60L 5/40 343/711

* cited by examiner

*Primary Examiner* — Andrea Lindgren Baltzell
(74) *Attorney, Agent, or Firm* — AU LLC; Adam E. Urbanczyk

(57) ABSTRACT

Provided is a power antenna adapter insertable into a power antenna mast housing to enable the utilization of an unpowered antenna through a power antenna unit of the type used in a motor vehicle and the like.

8 Claims, 6 Drawing Sheets

POWER ANTENNA ADAPTER

FIELD OF THE INVENTION

This disclosure relates to a power antenna adapter. More particularly, a means of adapting a power antenna system to accept and utilize a fixed antenna mast.

DESCRIPTION OF THE RELATED ART

Power antennas such as those used on automobiles are well known in the art. Power antenna systems, as installed into an automobile, will comprise a motor or elevating mechanism to raise and lower the antenna mast upon, usually, the automobile's radio being powered up. Power antennas are often vehicle model-specific as space claims into which power antenna housing and mechanisms will fit will often vary model-to-model. Thus, in the event a power antenna fails, finding and acquiring a replacement can be difficult and physically replacing the broken power antenna can be time-consuming expensive.

There remains a need for a device that can be used to easily adapt a power antenna to accept a fixed antenna, and thus effectively convert a power antenna system to a fixed antenna system.

BRIEF SUMMARY OF THE INVENTION

The present invention is a power antenna adapter. The adapter, at its first end, has an electrically conductive member that comprises at least one tab that extends from the member. The adapter has a distal second end that terminates in an electrically conductive plug that is secured into the electrically conductive member by a molded crown. An electrically conductive insert is placed into a receptacle disposed into the electrically conductive plug. The molded crown has a medial lip on the top and bottom of which are flexible bands. The adapter is inserted into an evacuated power antenna mast housing the inner surface of which are engaged by the tabs. An antenna is installed onto the top of the adapter, via the electrically conductive insert, and can provide ambient radio or other electromagnetic signals through the adapter, into the power antenna via its mast housing and features therein, and to a radio or other receiver.

BRIEF DESCRIPTION OF THE FIGURES

The accompanying figures and drawings, incorporated into and forming part of the specification, service to further illustrate the present invention, its various principles and advantages, and its varying embodiments.

DETAILED DESCRIPTION

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials or operations are not shown or described in detail to avoid obscuring certain aspects.

Figure 1:
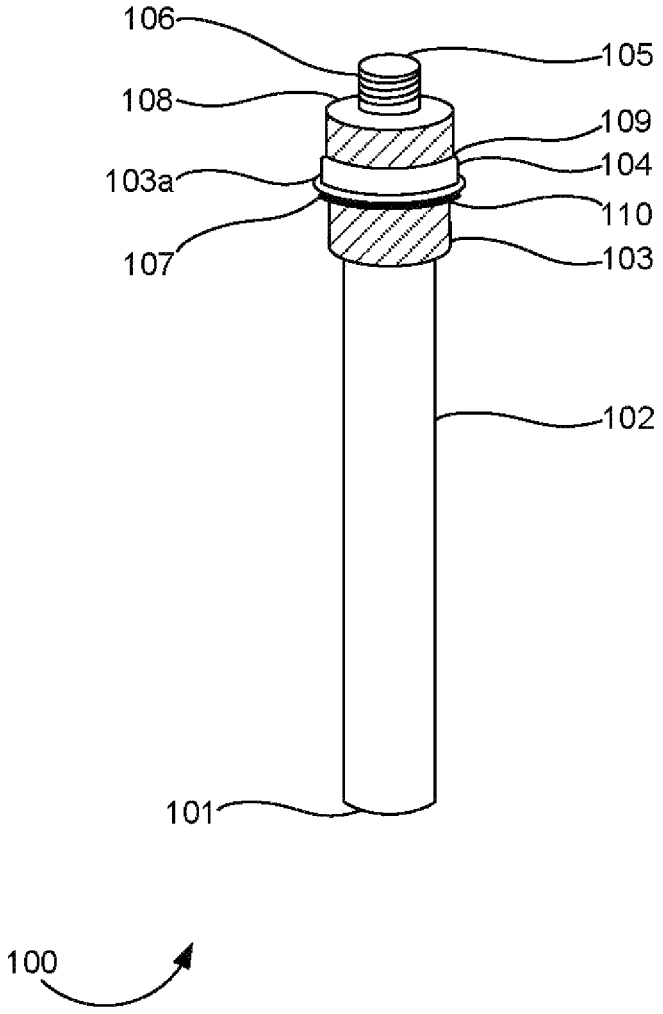
FIG. 1 illustrates an isometric view of a power antenna adapter.

FIG. 1 illustrates an isometric view of a power antenna adapter 100. The power antenna adapter consists of an electrically conductive elongated member 102. The electrically conductive elongated member 102 has two ends: a first end 101 and a distal second end having a molded crown 103. The molded crown 103 secures the second end of electrically conductive elongated member 102 to the electrically conductive plug 108. The electrically conductive plug 108 has a receptacle 106 for receiving an electrically conductive insert 105, in this illustration a threaded electrically conductive member that rests in the receptacle 106. A medial lip 103*a* is disposed around the circumference of the molded crown 103. A first flexible band 104 rests around the molded crown 103 within a first groove 109 and atop the medial lip 103*a*. A second flexible band 107 rests around the molded crown 103 within a second groove 110 and underneath the medial lip 103*a*.

Figure 2:
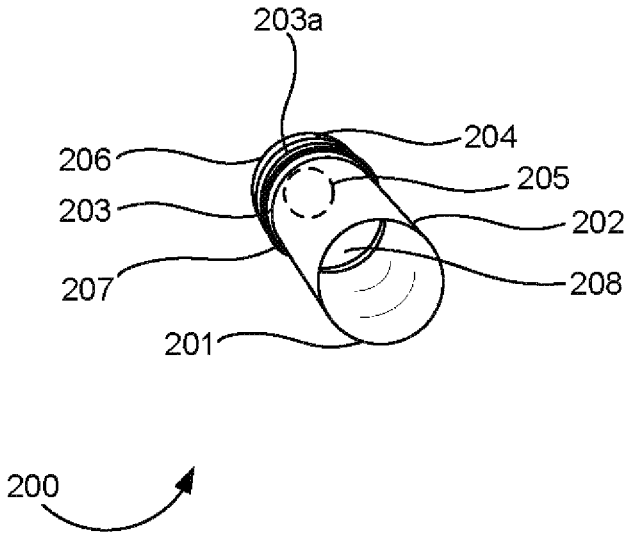
FIG. 2 illustrates a bottom perspective view of the power antenna adapter.

The electrically conductive elongated member 102 may be made steel, metal alloy, or any electrically conductive material which may be castable or workable into a tube or sleeve-like configuration and which has sufficient impedance so as to allow for the transmission of radio-band electromagnetic signals along the member from the electrically conductive plug to a radio receiver through a power antenna mast housing. The molded crown 103 may be made of a polymer, rubber, or other material which is principally an electrical insulator yet is sufficiently waterproof and strong to secure the electrically conductive plug 108 within and against the electrically conductive elongated member 102 in automotive environments. The electrically conductive plug 108 may be made of brass or other electrically-conductive metal alloy that is also, preferably, corrosion resistant so as to withstand typical automotive environments. The first flexible band 104 and second flexible band 107 may be made of electrically insulating polymer, rubber, or other flexible material. The electrically conductive plug 108 and electrically conductive elongated member 102 have impedances which allow the transmission of radio signals received from the environment therewith FIG. 2. illustrates a bottom perspective view of the power antenna adapter. The power antenna adapter 200 has an electrically conductive elongated member 202 having a first end 201 and distal second end 206. The first end 201 is open. The electrically conductive plug 208 resides in the distal second end 206. The molded crown 203 secures the electrically conductive plug 208 within and against the electrically conductive elongated member 202. A medial lip 203*a* is disposed around the circumference of the molded crown 203. A first flexible band 204 rests around the molded crown 203 and atop the medial lip 103*a*. A second flexible band 207 rests around the molded crown 203 and underneath the medial lip 203*a*. A receptacle 205 is disposed in the distal second end 206.

Figure 3:
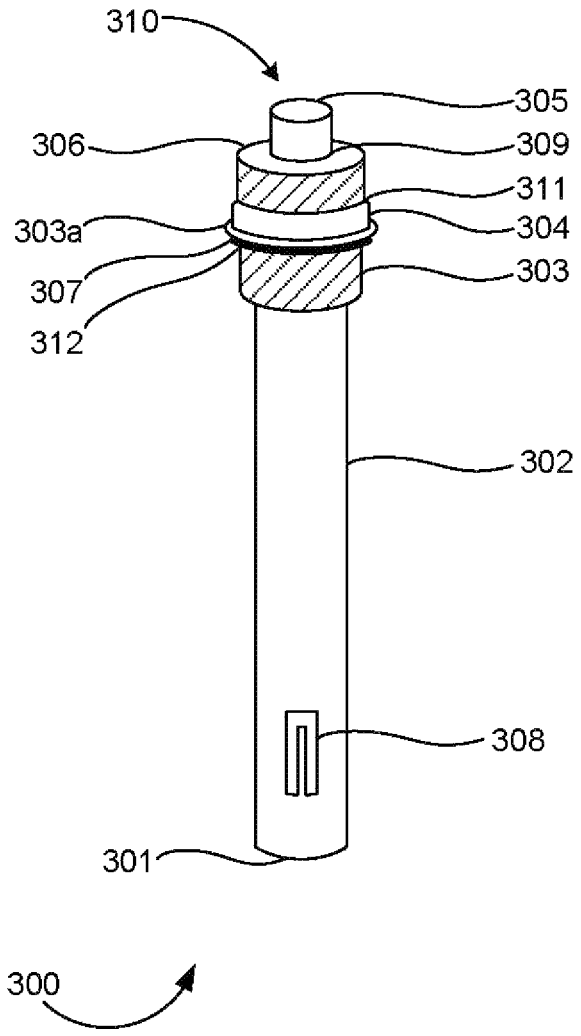
FIG. 3 illustrates a first side view of the power antenna adapter.

FIG. 3 illustrates a side view of an alternative embodiment of the power adapter. The electrically conductive elongated member 302 has a tab 308 located proximate the first end 301. The distal second end 310 terminates in a molded crown 303 that secures the electrically conductive plug 306 into an against the distal second end of the electrically conductive elongated member 302. A receptacle 309 is disposed into the electrically conductive plug 306. An electrically conductive insert 305 is inserted into the receptacle 309. A medial lip 303*a* is disposed around the circumference of the molded crown 303. A first flexible band 304 rests around the molded crown 303 within a first groove 311 and atop the medial lip 303*a*. A second flexible band 307 rests around the molded crown 303 within a second groove 312 and underneath the medial lip 303*a*. The tab is configured to bent away from the interior cavity of the electrically conductive elongated member 302.

Figure 4:
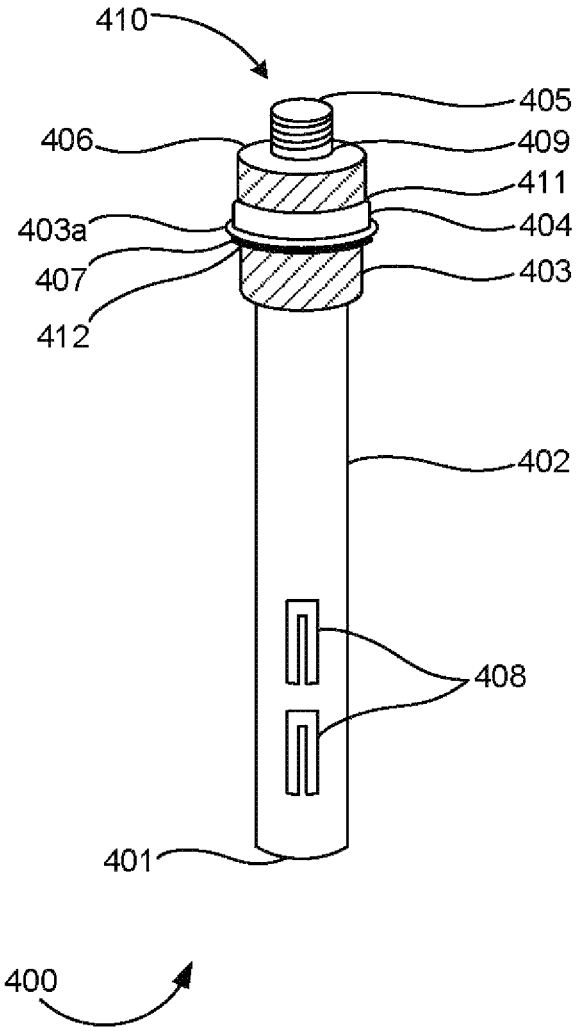
FIG. 4 illustrates a second side view of the power antenna adapter.

FIG. 4 illustrates a side view of an alternative embodiment of the power adapter 400. The electrically conductive elongated member 402 has a plurality of tabs 308 located proximate the first end 301 and along the length of the electrically conductive elongated member 402. The distal second end 410 terminates in a molded crown 403 that secures the electrically conductive plug 406 into an against the distal second end of the electrically conductive elongated member 302. A receptacle 409 is disposed into the electrically conductive plug 406. An electrically conductive insert 405 is inserted into the receptacle 409. A medial lip 403*a* is disposed around the circumference of the molded crown 403. A first flexible band 404 rests around the molded crown 403 within a first groove 411 and atop the medial lip 403*a*. A second flexible band 407 rests around the molded crown 403 within a second groove 412 and underneath the medial lip 403*a*. The plurality of tabs, which can be arranged anywhere on the surface of the electrically conductive elongated member 402, are configured to bent away from the interior cavity therefrom.

Figure 5:
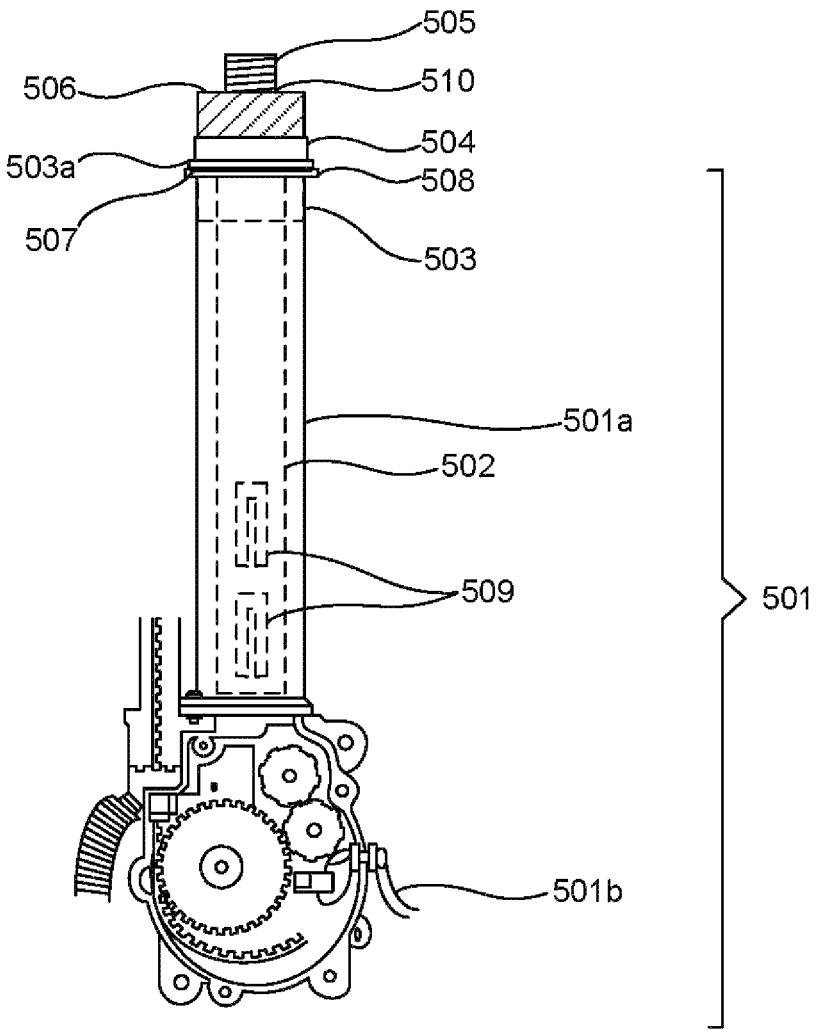
FIG. 5 illustrates a side view of the power antenna adapter installed into an exemplary power antenna unit.

FIG. 5 illustrate a cross-sectional side view of the power antenna adapter as-installed into a power antenna unit 501. The electrically conductive elongated member 502 is inserted into the mast housing 501*a* of the power unit 501 after the power antenna has been removed from the mast housing. The plurality of tabs 509 are bent away to compressively engage the inner surface of the mast housing 501*a* to secure the electrically conductive elongated member 502 therein. The electrically conductive elongated member 502 is completely inserted into the mast housing 501*a* until the medial lip 503*a* rests atop the top portion 508 of the mast housing 501*a*. The second flexible band 507 further secures the molded crown 503 within the mast housing and forms a waterproof seal. A first flexible band 504 rests atop the medial lip 503*a*. The electrically conductive plug 506 is secured in the molded crown 503, and the electrically conductive insert 505 is placed within the receptacle 510.

Figure 6:
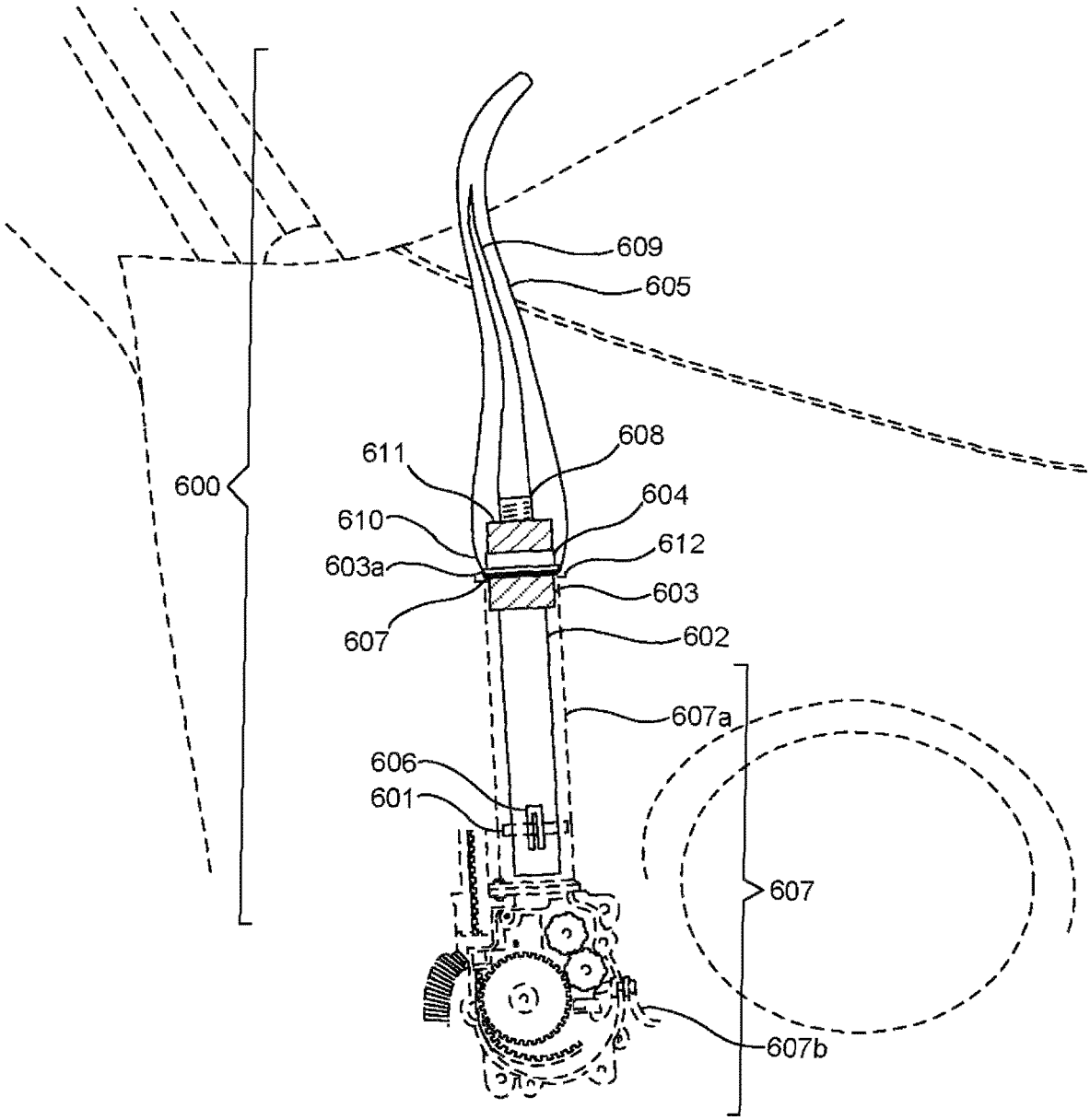
FIG. 6 illustrates a side view of the power antenna adapter installed in into a motor vehicle's power antenna unit.

FIG. 6 illustrates an isometric view of the power antenna adapter as-installed into a power antenna unit 607 as the power antenna unit 607 is installed into a motor vehicle 600. The electrically conductive elongated member 602 is inserted into the mast housing 607*d* of the power antenna unit 607 where a tab 606 is bent radially outward from the electrically conductive elongated member to engage an appurtenance 601 on the inner surface of the mast housing 607*a*. The electrically conductive elongated member 602 is completely inserted into the mast housing 607*a* until the medial lip 603*a* rests atop the top portion 612 of the mast housing 607*a*. The second flexible band 607 further secures the molded crown 603 within the mast housing 607*a* and forms a waterproof seal. An antenna 605 is installed onto the top of the molded crown 603 by attaching to the electrically conductive insert 608. The bottom portion of the antenna 610 secures around the first flexible band 604 to form a waterproof seal. The inner signal conductor 609 of the antenna 605 is in electrical communication with the electrically conductive insert 608, the electrically conductive plug 611, electrically conductive elongated member 602, the mast housing 607*a*, and through the power unit signal relay 607*b* to communicate radio signals from the automotive environment to a radio receiver within the motor vehicle. In an alternate embodiment, the tab 606 electrically engages at least one wire within the mast housing 607*a* to create the electrical connection between the signal conductor 609 of the antenna 605 and the power unit signal relay 607*b*. By way of example, where there is a plurality of tabs 509 as shown in FIG. 5, some tabs may be extended outward from the electrically conductive elongated member to secure it to the inside of the mast housing 501*a* whereas other tabs are extended inwards, or in other configurations, to engage electrical leads which may reside within the mast housing after the power antenna is removed therefrom.

Although the above detailed descriptions relate to specific preferred embodiments as the inventor presently contemplates, it will be understood that the invention in its broad aspects includes mechanical, chemical, and functional equivalents of the elements described herein. Various details of design and construction may be modified without departing from the true spirit and scope of the invention which is set forth in the following claims. Other embodiments, which will be apparent to those skilled in the art and which practice the teachings herein set forth, are intended to be within the scope and spirit of the invention.

I claim:

1. A power antenna adapter for a motor vehicle radio receiver system and the like, comprising an electrically conductive elongated member having a first end and a distal second end;

an electrically conductive plug disposed into the second end, the electrically conductive plug having a receptacle;

a molded crown disposed around the second end and the electrically conductive plug, the molded crown having a medial lip disposed around the circumference of the molded crown, the molded crown having a first groove disposed around the circumference of the molded crown above the medial lip and a second groove disposed around the circumference of the molded crown below the medial lip;

a first flexible band disposed in the first groove;

a second flexible band disposed in the second groove;

an electrically conductive insert located in the receptacle; and at least one tab proximate the first end radially extendable from the electrically conductive elongated member.

2. The power antenna adapter of claim 1 wherein the electrically conductive insert and the receptacle are threaded.

3. An antenna system for motor vehicles and the like, comprising:

a power source;

a radio receiver, or the like, connected to the power source;

a power antenna unit energizable from the power source, the power antenna unit having a power antenna mast housing, the power antenna unit in electrical communication with the radio receiver;

an electrically conductive elongated member having a first end and a distal second end;

an electrically conductive plug disposed into the second end, the electrically conductive plug having a receptacle;

a molded crown disposed around the second end and the electrically conductive plug, the molded crown having a medial lip disposed around the circumference of the molded crown, the molded crown having a first groove disposed around the circumference of the molded crown above the medial lip and a second groove disposed around the circumference of the molded crown below the medial lip;

a first flexible band disposed in the first groove;

a second flexible band disposed in the second groove;

an electrically conductive insert located in the receptacle; and an antenna adapted to securely engage the molded crown above the medial lip, the antenna adapted to electrically communicate with electrically conductive plug.

4. The antenna system of claim 3, wherein the power antenna adapter comprises at least one tab proximate the first end radially extendable from the electrically conductive elongated member that engages an electrical interconnection means within the power antenna mast housing.

5. The antenna system of claim 3, wherein the antenna securely engages the molded crown by securing against the electrically conductive insert.

6. A method of installing a power antenna adapter, the method comprising:

providing a power antenna unit, the power antenna unit having a power antenna mast housing, the power antenna mast housing having a power antenna and extendable power antenna rod;

providing a power antenna adapter, the power antenna adapter comprising an electrically conductive elongated member having a first end and a distal second end, an electrically conductive plug disposed into the second end, the electrically conductive plug having a receptacle, a molded crown disposed around the second end and the electrically conductive plug, the molded crown having a medial lip disposed around the circumference of the molded crown, the molded crown having a first groove disposed around the circumference of the molded crown above the medial lip and a second groove disposed around the circumference of the molded crown below the medial lip, a first flexible band disposed in the first groove, a second flexible band disposed in the second groove;

removing the extendable power antenna rod from the power antenna mast housing;

inserting the first end into the evacuated power antenna mast housing until the second flexible member secures against the inner surface of the top portion of the power antenna mast housing;

depositing an electrically conductive insert into the receptacle;

attaching an antenna to the top of the molded crown above the medial lip wherein the antenna can electrically communicate with the electrically conductive plug.

7. The method of installing a power antenna adapter according to claim 6, wherein the power antenna adapter comprises at least one tab proximate the first end radially extendable from the electrically conductive elongated member that engages an electrical interconnection means within the antenna mast housing.

8. The method of installing a power antenna adapter according to claim 6, wherein the antenna securely engages the molded crown by securing against the electrically conductive insert.

* * * * *